US005471763A

United States Patent [19]

McArthur

[11] Patent Number: 5,471,763

[45] Date of Patent: Dec. 5, 1995

[54] NOZZLE ATTACHMENT FOR A HAIR DRYER

[75] Inventor: John McArthur, Mid-Levels, Hong Kong

[73] Assignee: Wik Far East Limited, Quarry Bay, Hong Kong

[21] Appl. No.: 293,012

[22] Filed: Aug. 18, 1994

[30] Foreign Application Priority Data

Aug. 18, 1993 [GB] United Kingdom ..... 9317138

[51] Int. Cl.[6] ..... A45D 20/00

[52] U.S. Cl. ..... 34/96; 34/97; 392/360; 392/361; 392/362; 392/363; 392/364; 392/365; 392/366; 392/367

[58] Field of Search ..... 34/96, 97; 392/360, 392/361, 362, 363, 364, 365, 366, 367, 368, 369, 379, 380, 381, 382, 383, 384, 385

[56] References Cited

U.S. PATENT DOCUMENTS 3,797,752 3/1974 Cercone .
3,860,174 1/1975 Cercone .
4,132,360 1/1979 Lee, Jr. .
4,602,146 7/1986 Barns et al. .
5,054,211 10/1991 Shulman .
5,161,317 11/1994 McDougall ..... 34/97

FOREIGN PATENT DOCUMENTS 2268060 1/1994 United Kingdom .

*Primary Examiner*—Henry A. Bennet
*Assistant Examiner*—Sidharth Ohri
*Attorney, Agent, or Firm*—Robert W. Becker & Associates

[57] ABSTRACT

A nozzle attachment for a hair dryer has a cylindrical element for connecting a flow-directing member to the nozzle of a hair dryer. The flow-directing member deflects the air coming from the hair dryer by a certain acute angle. The flow-directing member is rotatable relative to the cylindrical element. Vanes are provided within the flow-directing member. They are slanted to the direction of air flow from the hair dryer, so that impingement of air on the vanes causes the flow-directing member to rotate thus providing air flow having a continually varying flow direction.

11 Claims, 2 Drawing Sheets

NOZZLE ATTACHMENT FOR A HAIR DRYER

BACKGROUND OF THE INVENTION

The present invention relates to a nozzle attachment for a hair dryer.

Hair dryers which blow a stream of hot air onto hair to be dried have been known for many years. A basic hair dryer comprises a fan, a heating element and a casing forming a direction nozzle through which air heated by the heating element is blown by the fan.

It is an object of the invention to provide a nozzle attachment for a hair dryer which improves hair drying.

SUMMARY OF THE INVENTION

The nozzle attachment for a hair dryer according to the present invention is primarily characterized by:

a flow-directing member with an inlet and an outlet for air, the flow-directing member being rotatable about an axis of rotation;

means for driving the flow-directing member in rotation, the means for driving connected to the flow-directing member; and the outlet deflecting the air entering through the inlet at an acute angle to the axis of rotation of the flow-directing member.

Preferably, the means for driving comprises a turbine connected inside the flow-directing member. The turbine advantageously comprises at least one vane positioned radially within the flow-directing member perpendicular to a direction of flow of air entering through the inlet, the vane slanted relative to the direction of flow of air.

The flow-directing member expediently comprises an angled pipe section. The outlet is provided at a free end of the angled pipe section and is slanted relative to a direction of flow of air entering through the inlet.

In a preferred embodiment of the present invention, the nozzle attachment further comprises means for attaching the flow-directing member to the hair dryer. The flow-directing member is advantageously rotatable relative to the means for attaching.

The means for attaching is a substantially cylindrical element having at a first end thereof a means for engaging a snap fit connector at the nozzle of a hair dryer and having at a second end thereof a means for receiving the flow-directing member.

Expediently, the means for receiving comprises a connector positioned on the central axis of the cylindrical element. The turbine comprises a boss and a central spindle extending through the boss and inserted into the connector such that the turbine together with the flow-directing member is rotatable within the connector.

The boss comprises a throughbore through which the spindle extends, whereby the throughbore is provided with a friction-reducing bearing.

The means for receiving comprises ribs extending radially between the connector and an inner wall of the cylindrical element for fastening the connector to the cylindrical element.

Advantageously, the connector has a cylindrical shape and is positioned such that a longitudinal axis thereof coincides with the central axis of the cylindrical element. The connector has a conical end pointing toward the first end and a frusto-conical bore open toward the second end for receiving the central spindle.

The flow-directing member has a cylindrical section with an external cylindrical surface. The cylindrical element has at the second end a section with an internal cylindrical surface. The radius of the internal cylindrical surface is larger than the radius of the external cylindrical surface. The external cylindrical surface is received in the section with the internal cylindrical surface.

According to the present invention the nozzle attachment for a hair dryer provides means for varying the direction of air flow exiting from the hair dryer. The means for varying is in the form of a rotatable flow-directing member. The nozzle attachment has a means for driving the flow-directing member in rotation, wherein the outlet of the flow-directing member directs the air at an angle to the axis of rotation of the flow-directing member.

Preferably, the means for driving comprises a turbine having at least one vane disposed radially in the flow-directing member, the vane being slanted relative to the direction of air flow so that air impingement causes a rotational force to be exerted on the flow-directing device.

According to the present invention, the flow directing devices rotates due to the vanes disposed therein. With the vanes the flow direction of the air from the hair dryer is also rotated, thus causing greater disturbance to the hair than direct impingement of air resulting in a faster drying action of the hair dryer. Since the hair is disturbed to a greater extent, the hair will have greater body when dried.

BRIEF DESCRIPTION OF THE DRAWINGS

An embodiment of the invention will now be described by way of example with reference to the accompanying drawings in which:

FIG. 3 is a cross-sectional view through a vane of the flow-directing member of FIG. 2 in the direction 3'—3' of FIG. 2*a.

DESCRIPTION OF PREFERRED EMBODIMENTS

Figure 1B:
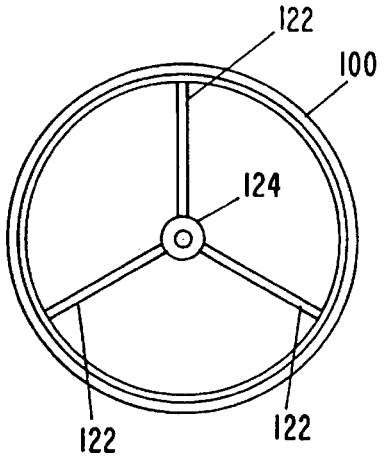
FIGS. 1*a, b* show two views of a cylindrical element for attaching the flow-directing member to a hair dryer, FIG. 1*a* being a cross-sectional view and FIG. 1*b* being a view in the direction of arrow 1 of FIG. 1*a;*
Figure 1A:
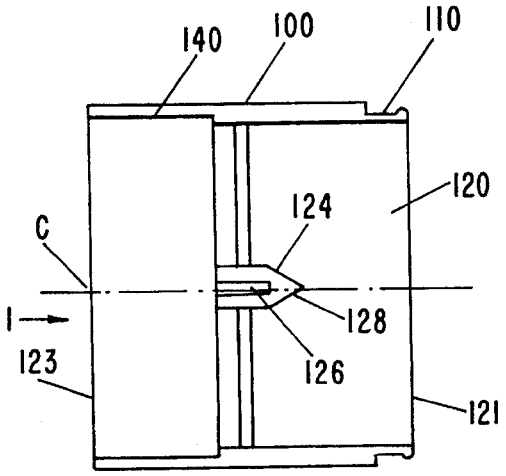

With reference to the Figures, an embodiment of the invention is shown which comprises a means for attaching 100 for connecting the nozzle attachment to a hair dryer and a flow-directing member 200 connected to the means for attaching 100 so as to be rotatable relative thereto.

The means for attaching 100 comprises a cylindrical element 120 having a means for engaging 110, for example, in the form of a groove arranged at a first end 121 to engage a corresponding internal snap fit connector of a hair dryer nozzle (not shown). It will be readily understood that this means for engaging can be adapted to suit any make or model of hair dryer to allow the means for attaching 100 to engage the hair dryer nozzle.

The generally hollow cylindrical element 120 has three radially aligned ribs 122 disposed therein. The ribs 122 together serve to mount a means for receiving (connector) 124 arranged on the central axis C of the cylindrical element 120. The connector 124 is provided with a frusto-conical bore 126 and, in order to reduce drag, is provided with a conical end 128 pointed in the direction of oncoming air flow A.

Figure 3:
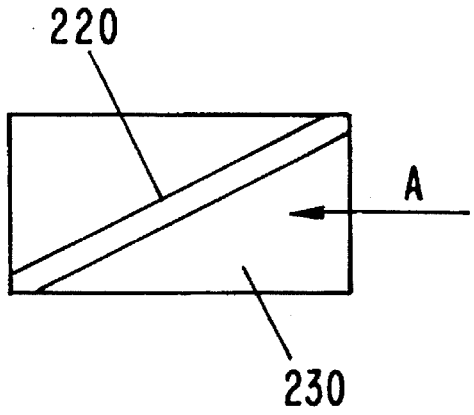

The flow-directing member 200 includes a hollow cylindrical section 210 with an inlet 202 and an outlet 201. The cylindrical section 210 has an external cylindrical surface 212 of slightly smaller diameter than a corresponding internal cylindrical surface 140 of a section of the cylindrical element 120 at the second end 123. A turbine comprising three vanes 220 is provided within the cylindrical element 120. The vanes 220 support a boss 230 which is provided with an axial throughbore 232. The vanes 220 are slanted relative to the direction of air flow A entering the flow-directing member 200 at the inlet 202 as shown in FIG. 3.

The cylindrical section 212 is connected to a flow-directing section 240 which comprises a curved portion having the outlet 201 positioned at a slant (acute angle $\alpha$).

Figure 4:
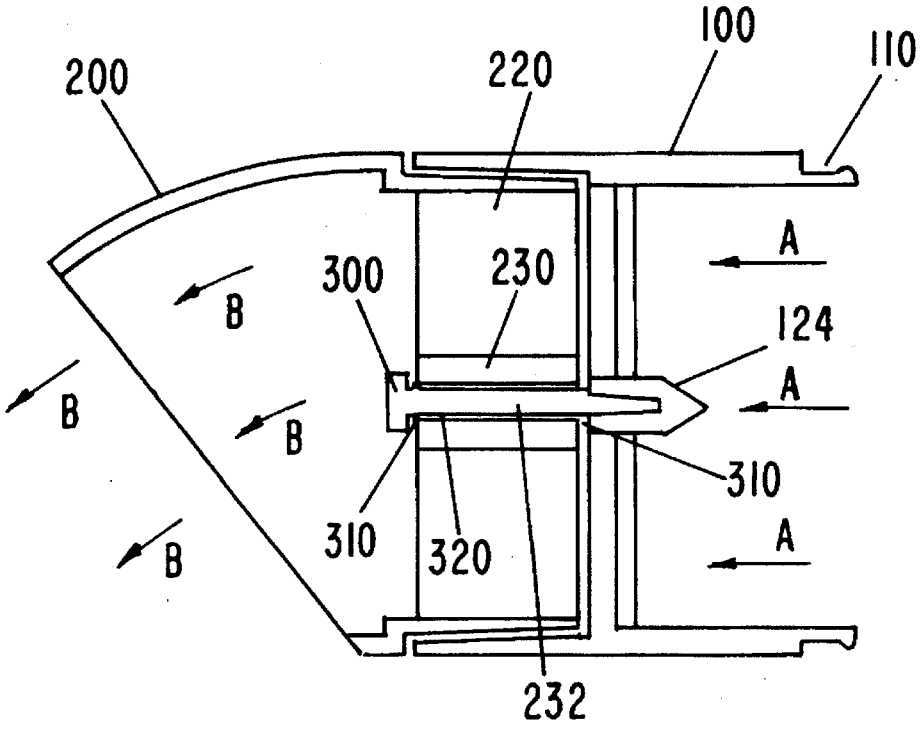
* and FIG. 4 is a cross-sectional view showing the cylindrical element and the flow-directing member of FIGS. 1–3 connected to one another.

The means for attaching 100 and the flow-directing member 200 are shown connected in FIG. 4. A steel pin 300 is passed through the throughbore 232 in boss 230 and engages with an interference fit the connector 124. Washers 310 and a Teflon bearing 320 are also provided in order to reduce rotational friction between the flow-directing member 200 and the means for attaching 100.

Figure 2B:
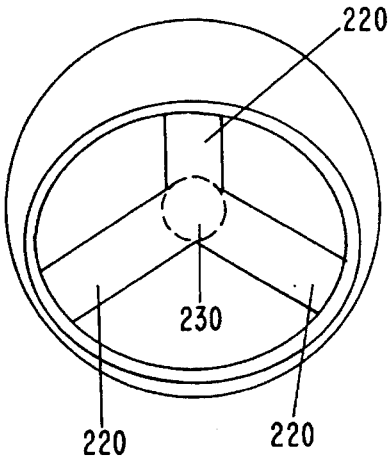
FIGS. 2*a, b* show two views of a flow-directing member, FIG. 2*a* being a cross-sectional view and FIG. 2*b* being a view in the direction of arrow 2 of FIG. 2*a;*
Figure 2A:
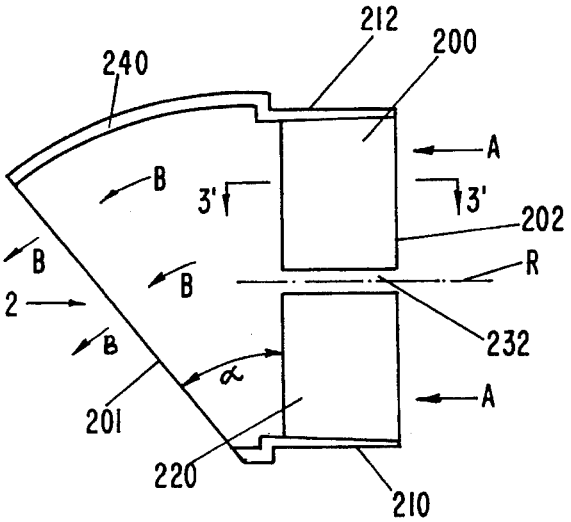

In use, the flow-directing member 200 will cause air blown in from the hair dryer through cylindrical element 120 to change direction to that of arrows B in FIGS. 2 and 4. Accordingly, the air exits from the flow-directing member 200 at an acute angle of, for example, approximately 30° (as shown in the described embodiment) to the central axis C of the cylindrical element 120 and the rotational axis R of member 200. However, the flow of the air through the nozzle attachment also impinges upon vanes 220 causing the flow directing member 200 to rotate about pin 300 (axis of rotation R). The net result is that the air from the hair dryer will not only be deflected to flow direction B, but will also rotate as a function of the speed of rotation of the flow-directing member 200 thus providing air flow substantially shaped as a cone. Such an air flow pattern provides greatly improved drying characteristics compared to the uni-directional air flow of a conventional hair dryer.

Although the invention has been described in reference to a self-driven flow-directing member, this is not to be construed as a limiting example. It is conceivable to provide a separate motor or a geared connection to the hair dryer fan motor. Furthermore, although the invention has been disclosed as a nozzle attachment to be connected to a hair dryer, the invention may be realized by forming the nozzle attachment as an integral part of a hair dryer.

The present invention is, of course, in no way restricted to the specific disclosure of the specification and drawings, but also encompasses any modifications within the scope of the appended claims.

What I claim is:

1. A nozzle attachment for a hair dryer comprising:

a flow-directing member with an inlet and an outlet for air, said flow-directing member rotatable about an axis of rotation;

means for driving said flow-directing member in rotation, said means for driving connected to said flow-directing member; and said outlet deflecting the air entering through said inlet at an acute angle to said axis of rotation of said flow-directing member, wherein said flow-directing member comprises an angled pipe section and wherein said outlet is provided at a free end of said angled pipe section and is slanted relative to a direction of flow of air entering through said inlet.

2. A nozzle attachment according to claim 1, wherein said means for driving comprises a turbine connected inside said flow-directing member.

3. A nozzle attachment according to claim 2, wherein said turbine comprises at least one vane positioned radially within said flow-directing member perpendicular to a direction of flow of air entering through said inlet, said vane slanted relative to said direction of flow of air.

4. A nozzle attachment according to claim 3, further comprising means for attaching said flow-directing member to the hair dryer.

5. A nozzle attachment according to claim 4, wherein said flow-directing member is rotatable relative to said means for attaching.

6. A nozzle attachment according to claim 5, wherein said means for attaching is a substantially cylindrical element having at a first end thereof a means for engaging a snap fit connector at the nozzle of a hair dryer and having at a second end thereof a means for receiving said flow-directing member.

7. A nozzle attachment according to claim 6, wherein:

said means for receiving comprises a connector positioned on the central axis of said cylindrical element; and said turbine comprising a boss and a central spindle extending through said boss and inserted into said connector such that said turbine together with said flow-directing member is rotatable within said connector.

8. A nozzle attachment according to claim 7, wherein said boss comprises a throughbore through which said spindle extends, said throughbore provided with a friction-reducing bearing.

9. A nozzle attachment according to claim 7, wherein said means for receiving comprises ribs extending radially between said connector and an inner wall of said cylindrical element for fastening said connector to said cylindrical element.

10. A nozzle attachment according to claim 7, wherein said connector has a cylindrical shape and is positioned such that a longitudinal axis thereof coincides with said central axis of said cylindrical element, said connector having a conical end pointing toward said first end and having a frusto-conical bore open toward the second end for receiving said central spindle.

11. A nozzle attachment according to claim 6, wherein:

said flow-directing member has a cylindrical section with an external cylindrical surface;

said cylindrical element has at said second end a section with an internal cylindrical surface;

a radius of said internal cylindrical surface is larger than a radius of said external cylindrical surface; and said external cylindrical surface is received in said section with said internal cylindrical surface.

* * * * *